US005530617A

United States Patent [19]

Bonavia et al.

[11] Patent Number: 5,530,617

[45] Date of Patent: Jun. 25, 1996

[54] EXCITER CIRCUIT WITH OSCILLATORY DISCHARGE AND SOLID STATE SWITCHIING DEVICE

[75] Inventors: Howard V. Bonavia, Groton; Dale F. Geislinger, Norwich, both of N.Y.

[73] Assignee: Simmonds Precision Engine Systems, Inc., Akron, Ohio

[21] Appl. No.: 242,808

[22] Filed: May 12, 1994

[51] Int. Cl.[6] ..... F02P 3/09

[52] U.S. Cl. ..... 361/253; 123/596

[58] Field of Search ..... 361/247, 253, 361/256, 257; 123/594, 596, 598, 605

[56] References Cited

U.S. PATENT DOCUMENTS

| | | | |
|---|---|---|---|
| 4,167,767 | 9/1979 | Courier de Mere | 361/256 |
| 4,418,375 | 11/1983 | Ober | 361/253 |
| 4,589,398 | 5/1986 | Pate et al. | 123/596 |
| 4,886,036 | 12/1989 | Johansson et al. | 123/596 |

FOREIGN PATENT DOCUMENTS 962417 7/1964 United Kingdom .

OTHER PUBLICATIONS

SCR Applications Handbook, Sep. 1974, pp. 140–145, Edited by Dr. Richard J. Hoft.

Society of Automotive Engineers, Inc., Aerospace Information Report, AIR 784A, Interrelation Of Engine Design And Burner Configuration With Selection And Performance Of Electrical Ignition Systems For Gas Turbine Engines, issued Jul. 15, 1963, revised Jun. 15, 1975.

*Primary Examiner*—Fritz M. Fleming

*Attorney, Agent, or Firm*—Leonard L. Lewis; William E. Zitelli

[57] ABSTRACT

An oscillatory discharge exciter includes an input connectable to a power supply; an output connectable to an igniter; at least two energy storage elements for producing an oscillatory discharge of energy during an exciter discharge period; a unidirectional gated switch and a rectifier coupled in reverse parallel with each other such that the switch and rectifier control, during respective alternating half cycles, oscillatory discharge energy at the exciter output; and a circuit for gating the switch in response to voltage transitions across the switch. The gating circuit can also be used as a snubber circuit to add gate drive to slow devices, as well as to trigger a series of switching devices with the application of only a single external trigger signal to one of the devices. In an alternative embodiment, the gating circuit is replaced with a circuit for maintaining holding current through the switch to prevent the switch from recovering to a blocking condition.

24 Claims, 3 Drawing Sheets

08/2428

EXCITER CIRCUIT WITH OSCILLATORY DISCHARGE AND SOLID STATE SWITCHIING DEVICE

BACKGROUND OF THE INVENTION

The invention relates generally to exciter circuits for ignition systems used with internal combustion engines. More particularly, the invention relates to exciter circuits that utilize solid-state switches such as, for example, thyristors, as control devices for exciter circuit oscillatory discharge control.

A conventional ignition system for an internal combustion engine, such as, for example, a gas turbine aircraft engine, includes a charging circuit, a storage capacitor, a discharge circuit and at least one igniter plug located in the combustion chamber. The discharge circuit includes a switching device connected in series between the capacitor and the plug. For many years, such ignition systems have used spark gaps as the switching device to isolate the storage capacitor from the plug. When the voltage on the capacitor reaches the spark gap breakover voltage, the capacitor discharges through the plug and a spark is produced.

More recently, turbine engine and aircraft manufacturers have become interested in replacing the spark gap with a solid-state switch, such as an SCR or thyristor. This is due, in part, because a solid state switch typically operates longer than a spark gap tube which may exhibit electrode erosion. Also, solid state switches are produced in large volume making them less expensive than spark gaps which are individually crafted in small quantities. Furthermore, the storage capacitor's voltage at discharge remains essentially constant over the life time of the solid state switch, but can change significantly during the life of the spark gap due to electrode erosion.

In order to produce high peak powers at the igniter plug tip, high di/dt levels are generated with the exciter circuit. These high current transition rates create voltage and current reversals due to stray inductances that are present within the discharge circuit. When spark gap tubes are used as the switching device these voltage and current reversals are tolerable. However, solid state switches, such as thyristors, can be damaged by such reverse voltages. Consequently, exciter circuits employing the use of solid state switches typically include protective circuits to prevent the reverse voltages or to lessen their effect on the switches.

A common technique for preventing reverse voltages is to place a free wheeling diode on the discharge side of the switches to force a unidirectional discharge current through the igniter.

However, there are engine applications for which the use of an oscillatory discharge is required by the customer or end user. In such cases, the free wheeling diode cannot be used to protect the solid state switches. It is also necessary that the thyristor switches be able to conduct current every other cycle during the oscillatory discharge. If a switch turns off during a reverse current portion of the discharge, the switch must be turned back on for the next forward current portion of the discharge cycle.

An oscillatory discharge exciter design using an SCR thyristor is illustrated in U.K. Patent No. 962,417. This design includes the use of an SCR as the switching device and a reverse parallel diode to conduct the reverse discharge current relative to the direction of current flow through the switch. This simple design, however, is not suitable in many applications because the SCR could recover and block forward current flow during the negative current half-cycles.

The objective exists, therefore, for an oscillatory discharge exciter circuit that uses solid state switches and that can assure that the switching devices are in conduction for the forward current discharge portions of each oscillatory discharge cycle.

SUMMARY OF THE INVENTION

To the accomplishment of the aforementioned objectives, the invention contemplates, in one embodiment, an oscillatory discharge exciter including an input connectable to a power supply; an output connectable to an igniter; at least two energy storage elements for producing an oscillatory discharge of energy during an exciter discharge period; a unidirectional gated switch and a rectifier coupled in reverse parallel with each other such that the switch and rectifier control, during respective alternating half cycles, oscillatory discharge energy at the exciter output; and a circuit for gating the switch in response to voltage transitions across the switch.

The invention also contemplates in an exciter that provides electrical energy from a storage element to an igniter, the combination of a plurality of solid state gated switches used to couple discharge energy between the storage device and the igniter; a trigger circuit for applying a trigger signal to the gate of one of said switches; and a gating circuit responsive to said one device being triggered on for gating said other switches on.

The invention also contemplates the methods of use embodied in such apparatus, as well as a method for producing an oscillatory discharge from an exciter circuit through an igniter, comprising the steps of:

a. storing energy in a first energy storage device during a charging time period;
b. using a second energy storage device in combination with said first storage device to produce an oscillatory discharge for the igniter;
c. using a unidirectional gate controlled switch to isolate the first storage device from the igniter during the charging period;
d. using the switch in combination with a rectifier during respective alternating half cycles of discharge for controlling oscillatory discharge through the igniter; and
e. during a discharge period, re-gating the switch into conduction in response to voltage transitions across the switch.

These and other aspects and advantages of the present invention will be readily understood and appreciated by those skilled in the art from the following detailed description of the preferred embodiments with the best mode contemplated for practicing the invention in view of the accompanying drawings.

DETAILED DESCRIPTION OF THE INVENTION

Figure 1:
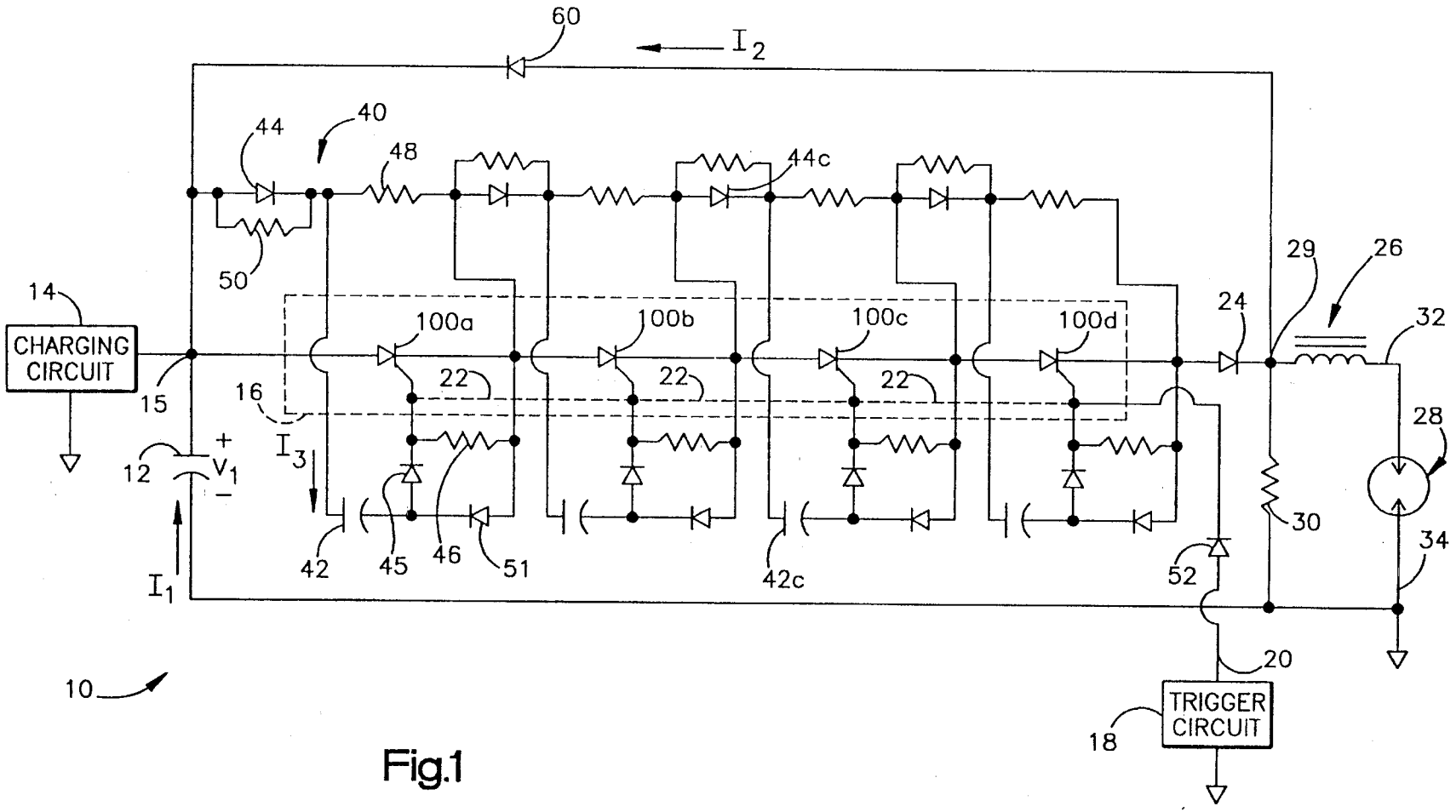
FIG. 1 is a simplified electrical schematic of an exciter circuit that includes an embodiment of the invention.

With reference to FIG. 1, an embodiment of an oscillatory discharge exciter apparatus using solid state switches according to the present invention is generally indicated with the numeral 10. Although the invention is described herein with respect to specific embodiments in combination with specific types of ignition systems, this description is intended to be exemplary and should not be construed in a limiting sense. Those skilled in the art will readily appreciate that the advantages and benefits of the invention can be realized with many different types of ignition systems and exciter designs including, but not limited to, those that include AC and/or DC charging systems, capacitive and other discharge configurations, periodic and single shot (e.g. rocket) ignition systems, high tension and low tension discharge circuits, and so on, to name just a few of the many different ignition systems. Furthermore, the invention can be used with ignition systems for many different types of engines, although the description herein is with specific reference to use with a gas turbine engine ignition system particularly suited for aerospace applications.

An exemplary low tension exciter 10 is shown in FIG. 1, and includes a main storage capacitance 12 that is connected to a charging circuit 14 at a power supply input node 15. The charging circuit 14 can be an AC or DC charger depending on the particular requirements for each application. The charging circuit design can be conventional, such as a DC inverter or a continuous AC supply circuit, for example.

The capacitance 12 is connected to one side of a switch mechanism outlined by the box 16. The switch 16 elements are represented in a generic manner as thyristor-type devices. In the embodiment described herein, the switch mechanism 16 includes a series of SCR solid state type switching devices 100*a–d*. Of course, an exciter circuit design can use any number of such devices, including only one, depending on the particular application. Typically, the number of devices 100 used will be based in part on the voltage required to charge the capacitance 12 to produce a spark at the igniter plug. By chaining several devices together in series, the voltage on the capacitance 12 can be increased since the voltage will be distributed across the devices 100. A suitable SCR device is part no. N060RH15 available from WESTCODE Semiconductors, Inc. Other solid state switching devices could be used, such as conventional GTO type devices, for example.

The apparatus 10 further includes a trigger control circuit 18 that triggers the switch mechanism 16 at the appropriate times to produce a desired spark rate. For example, the circuit 18 can trigger the switch 16 closed after the capacitance 12 reaches a predetermined charge level; or alternatively, for example, the control circuit 18 can trigger the switch 16 at a predetermined rate based on the desired spark rate. Other timing control scenarios can be used, of course, and the particular control circuit design will depend on the timing function to be generated as well as the type of switching device used, as is well known to those skilled in the art.

The trigger circuit 18 is shown connected to a gate of one of the switch devices 100*d* by a signal line 20. As shown by the phantom lines 22, the trigger circuit 18 could also be connected to the other switches 100*a–c* to trigger those devices directly using the same trigger signal. In this alternative case, the devices 100 are all triggered on at approximately the same time. In the embodiment of FIG. 1, however, and as will be explained in greater detail hereinafter, the trigger pulse on signal line 20 is connected to only one gate (for device 100*d*), and a circuit is provided that causes the other switches 100*a–c* to be triggered on.

The switching mechanism 16 is connected at the discharge side to the anode of a diode rectifier 24. This series connected diode can be used in the embodiment of FIG. 1 to prevent destructive voltage and current reversals across the SCRs, although use of the rectifier 24 in this embodiment is optional. The rectifier 24, when used, can be a high efficiency device, such as part no. RUR 30120 available from Harris Semiconductor. It should be noted that the series rectifier 24 can be disposed at the anode end or cathode end of the switch 16 (in FIG. 1 it is shown at the cathode end).

The rectifier 24 cathode is connected at a node 29 to a pulse shaping and output circuit which in this case includes an inductor 26. The output inductor 26 is typical in a low tension exciter circuit. Other pulse shaping circuits could be used depending on the particular application, and are well known, such as current and/or voltage step-up circuits and distributed or multiplexed output controls, just to name a few examples.

The inductor 26 is connected at an exciter output node 32, to an igniter 28 (shown in a representative manner) and is selected, depending on each particular application, to provide the required peak current to the igniter with an initial rate of rise that is within the rating of the switch 16. A discharge resistor 30 is used to provide a discharge path for the capacitance 12 in the event that the igniter 20 misfires or otherwise fails to spark, and to discharge the capacitor 12 after power to the exciter is turned off. The inductor 26, in combination with the main capacitance 12, forms an oscillatory LC circuit to produce an oscillatory discharge of energy through the igniter.

The exciter typically is connected to the igniter 28 by a conductor, such as a high voltage/current cable lead 32 and a return lead 34. In normal operation, when the switching mechanism 16 closes after the capacitor 12 is charged or as otherwise determined by the trigger circuit 18, the capacitor voltage is impressed across the igniter gap. Assuming the voltage across the plug gap exceeds the breakover voltage of the gap, a plasma or similar conductive path jumps the gap and the capacitor quickly discharges with current rising rapidly. Typical discharge times are on the order of tens of microseconds. Typical breakover voltages for a low tension circuit can require an exciter output open circuit voltage on the order of 2500–3000 VDC with a discharge current of about 600–1000 peak amps.

In accordance with one aspect of the invention, the exciter 10 is configured to produce an oscillatory discharge. By "oscillatory discharge" is meant that the discharge current and voltage wave forms for the exciter, such as, for example, the current through the igniter 28, reverse direction or polarity. This oscillatory discharge may be sinusoidal, although it need not be a pure sinusoid. In the embodiments described herein, an oscillatory discharge is established by oscillatory energy transfer between the storage capacitor 12 and the output inductor 26. In some applications, the inductor 26 need not be a discrete device but rather can be an energy storage element realized using the exciter's stray inductance and the inductance associated with the ignition leads (32, 34).

Because currently available thyristor devices, such as the SCR switches 100*a–d*, are intended to conduct current in the forward direction only, and further due to the presence of the blocking rectifier 24, a reverse diode 60 is provided to complete the oscillatory circuit path. Alternatively, a reverse parallel diode could be used across each switching device although this approach is less preferred due to added impedance.

Note that the inverse diode 60 is preferably disposed in parallel with the series combination of the switch 16 and the series rectifier 24. In this configuration, the reverse diode 60 protects the rectifier 24 from having to absorb the energy stored in stray inductances of the exciter. The reverse diode also lowers the blocking voltage requirement for the series rectifier 24 from about 1000 VDC to about 100 VDC (in the exemplary embodiment herein).

For purposes of explaining operation of the embodiments herein, the oscillatory discharge is referred to herein as having "positive" and "negative" half-cycles of energy discharge; with the "positive" half-cycles being those during which the switch 16 discharges energy through the igniter in the switch forward direction, and the "negative" half-cycles being those during which the rectifier 60 discharges energy through the igniter in a direction opposite that of the switch 16 (thus the reference to the diode 60 being inverse or reverse). Thus the terms positive and negative in this context, as well as reference to "reverse" discharge energy or current, are used for convenience as a reference in describing the oscillatory nature of the discharge through the igniter, and those skilled in the art will readily appreciate that different polarity designations (as to positive and negative voltages and current flow) can alternatively be adopted.

As noted herein, the embodiment of FIG. 1 includes a circuit associated with each switching device 100 which for convenience we will refer to as a re-trigger circuit 40. As each re-trigger circuit 40 operates substantially the same, only one will be described in detail.

It should be noted that the re-trigger circuit actually performs several functions. First, regardless of how the devices 100*a–d* are gated (e.g. with a respective trigger pulse or only one device gated), the re-trigger circuit functions as a snubber circuit that adds gate drive to each device 100 that is slow to turn on. Second, the circuit functions to trigger its respective switch device on, even if the external trigger signal is applied to only one gate (such as device 100*d* in FIG. 1). Third, the re-trigger circuit functions to turn the switching device back on should the device recover to a blocking state during the negative discharge current half-cycle. Note that the first two functions can be utilized in a unidirectional discharge exciter, as well as an oscillatory discharge exciter.

When a series string of switching devices is used, such as the series of SCR devices 100*a–d* in the described embodiment, the devices may have different transition times for turning on when their respective gates are triggered. This can result in excessive voltages across the anode/cathode junction of the slower devices. For example, in FIG. 1, if devices 100*a* and 100*b* begin to conduct current at an appreciably faster rate than device 100*c*, excessive anode/cathode voltages may appear across the slower device. Also, when the trigger pulse on signal line 20 is applied to device 100*d* only, that device will necessarily begin to turn on before devices 100*a–c*. To reduce the effect of different turn on transitions, a re-trigger circuit gate drive circuit 40 is provided for each switching device 100.

Each re-trigger circuit 40 includes a gate capacitor 42, a by-pass diode 44, a discharge resistor 50, a gate diode 45 and a gate return resistor 46. A series string of static balancing resistors 48 are also provided. The static balancing resistor 48 in each circuit 40 serves at least two purposes. First, these resistors operate in a conventional manner to provide static balance across the switching devices so that no single device 100 sees an excessive anode/cathode potential while the main capacitor 12 is charging. The balancing resistors 48 also serve to discharge the storage capacitor 12 after power to the exciter has been removed. The gate capacitor 42 is connected between the diode 44 cathode and the anode of gate diode 45; the gate diode 45 cathode being connected to the corresponding gate of the switching device 100*a*.

The gate resistor 46 is connected between the gate and cathode of the switching device 100*a*. A third diode 51 is provided between the switch 100*a* cathode and the gate capacitor 42. The diodes 45 and 51 are optional and primarily used to reduce the effects of negative voltage pulses at the switching device's gate when the device 100*a* first turns on. Such negative gate voltages, caused by the presence of the gate capacitor 42, would tend to pull drive current away from the gate during device turn-on when gate drive is most needed. The diodes 45, 51 suppress these negative voltage spikes.

Each re-trigger circuit 40 operates in the same basic manner. In general, the circuit 40 operation is based on the use of the gate capacitor 42 to provide gate drive current for the associated switching device 100. This gate drive is provided under various circumstances. In the oscillatory discharge embodiment of FIG. 1, during each negative current half-cycle (during which diode 60 conducts current), the gate capacitor 42 discharges through resistor 50, switch 100*a* and diode 51 (note that during the charging period, the capacitor 42 is charged by the circuit 14). The value of resistor 50 is selected to be small enough so that the capacitor 42 can quickly but safely discharge. When the negative current half-cycle ends, it is possible that switch 100*a* has recovered to a blocking state because the gate is not triggered and the anode to cathode current can fall below the holding current for the device. With device 100*a* blocking, the next positive discharge half-cycle causes a rapid anode to cathode voltage rise across the device 100*a*. This voltage transition is shunted by the diode 44 to the gate capacitor 42 which in turn provides a gate drive current pulse, thus re-triggering the device 100*a* back on. Thus, an oscillatory discharge can be produced at the output node 29.

The circuit 40 also will operate to trigger the device 100*a* into forward conduction should the device 100*a* be slow to turn on after devices 100*b–d* turn on first. Again, the fast rising anode to cathode voltage transition across the switch 100*a* causes the gate capacitor 42 to provide a gate boost signal to turn the switch on. In a similar manner, the circuits 40 can be used to auto-trigger devices 100*a–c* on when the external trigger from trigger circuit 18 is applied only to device 100*d*.

Figure 2:
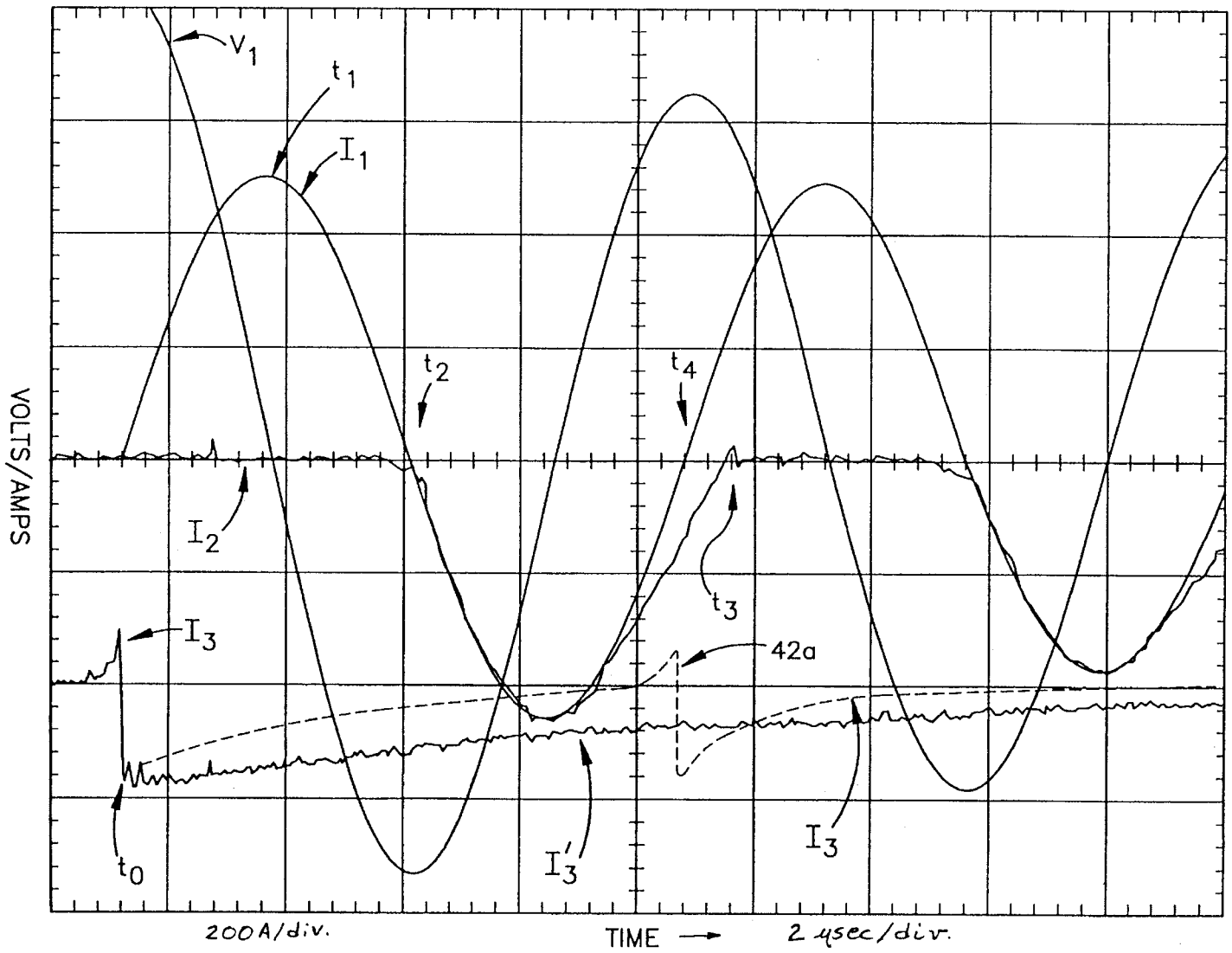
FIG. 2 is an exemplary graph of various signal wave forms that illustrate operation of the circuits described herein during the initial portion of a discharge cycle.

Operation of the exciter circuit 10 will best be understood in view of FIG. 2. FIG. 2 provides representative wave forms for various currents and voltages during an initial portion of a discharge cycle. Current $I_1$ represents the overall oscillatory discharge current, such as through the capacitor 12. Voltage $V_1$ represents the discharge voltage across the capacitor 12. Current $I_2$ represents current that flows through the inverse diode 60 during the negative half-cycles of the exciter oscillatory discharge; and current $I_3$ represents the current through the gate capacitors 42.

At time $t_0$ the trigger circuit 18 applies a gate drive signal to the switching device 16. Prior to time $t_0$, all the devices 100*a–d* are off (blocking) and the capacitor 12 is charged by the charging circuit 14. At the appropriate time determined by the trigger circuit 18, a trigger pulse is applied to the gate of device 100*d*. The circuits 40 operate to assist all the switching devices to turn on at about the same time. The discharge current rises rapidly and the voltage across the capacitor 12 begins to decrease as the switch 16 turns on thus causing the capacitor 12 to discharge through the inductor 26 and igniter 28. Note that during the first half cycle of current, 12 is virtually zero because the diode 60 is reverse biased.

The forward switch 16 current $I_1$ through the inductor 26 results in energy storage in that device so that at time $t_1$ the current in the inductor reaches a peak and the voltage across the capacitor 12 is about zero and then reverses polarity. As the forward current through the switch 16 reaches zero at about time $t_2$, the diode 60 begins to conduct the negative half-cycle of the oscillatory discharge energy, and these oscillatory cycles repeat until the stored energy is dissipated through the igniter.

Note that at time $t_0$, the current $I_3$ pulses due to the operation of the gate drive circuit 40. Furthermore, the circuits 40 operate such that the switches 100*a–d* are self-triggering in the event that one or more of the switches turns off during a negative current half-cycle. As an example, suppose device 100*a* turns off (i.e. recovers) during the negative discharge current period between time $t_2$ and $t_3$. When the diode 60 stops conducting current, a rapid positive (forward) dv/dt change across the anode to cathode junction of the device 100*a* occurs (keeping in mind that during the time that the diode 60 is conducting current the anode to cathode voltage of the switch 100*a* is approximately equal to the small forward voltage drop of the diode 60). This anode to cathode voltage transition occurs at the beginning of the next positive current half-cycle (approximately at time $t_4$), and causes a current $I_3$ (a re-trigger pulse 42*a*) into the gate of the device 100*a* that is proportional to the rate of change of the voltage across the capacitor 42. Because the capacitor 42 is coupled to the switch gate, the device will self-trigger back on for the next forward current discharge period. Therefore, the switch 16 is always on for the forward current half-cycle portions of the discharge cycle, and an oscillatory discharge is realized with the use of solid state switches.

It will be noted in FIG. 2 that there is shown a delay between the time when the next positive current cycle through the switch 16 begins ($t_4$) and the time designated for when the diode 60 stops conducting current ($t_3$). This delay may arise, for example, due to circuit inductances, and in different applications may be a zero or very short time delay.

Figure 3:
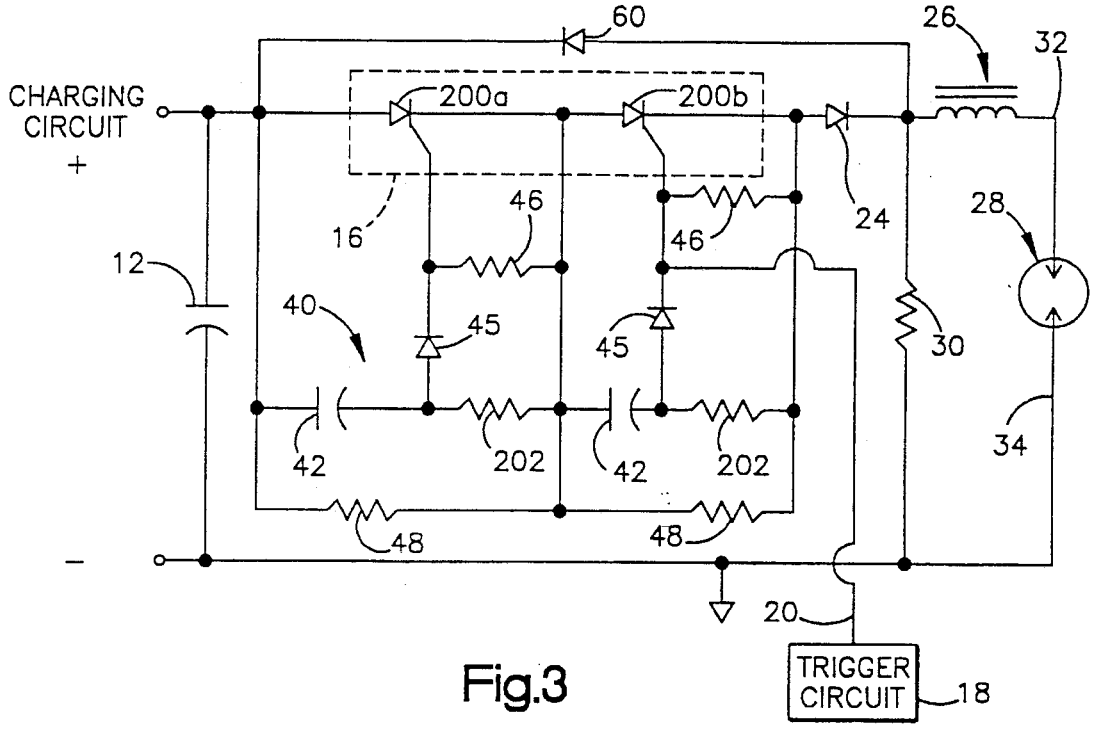
FIGS. 3 and 4 are electrical schematics of additional embodiments of the invention.

FIG. 3 illustrates an alternative embodiment of the oscillatory discharge exciter including a simplified gate drive circuit. In this embodiment, we show two switching devices 200*a* and 200*b* (like elements are given like reference numerals as in FIG. 1, although for clarity the switching devices are numbered 200 because only two are shown in FIG. 3). A series rectifier 24 is optionally provided to minimize reverse voltages and currents to protect the switches 200*a* and 200*b*. In this embodiment, the gate capacitor 42 is connected between the switch anode and gate terminals. A gate diode 45 is provided to block negative voltage pulses from the capacitor 42 drawing away gate drive current when device 200*a* begins to conduct. A return resistor 202 is provided to allow the capacitor 42 to discharge during each negative discharge half-cycle. Balancing resistors 48 are used as in FIG. 1. Reverse diode 60 is provided in parallel with the series combination of switch 16 and series rectifier 24.

Operation of this embodiment is similar to FIG. 1, in that the gate capacitor 42 produces a gate drive current in response to a rising anode to cathode voltage across the switch 200*a*/200*b*. This anode to cathode voltage rise can occur, as in FIG. 1, due to the trigger signal being applied to device 200*b* only; or if device 200*a* turns on slower than 200*b*; or if device 200*a* (or 200*b*) recovers to a blocking state during a negative current half-cycle. Again, the concepts embodied in the circuit 40 can be applied to a unidirectional discharge exciter when either a single device (in a chain) is externally triggered or as a snubber circuit to add gate boost current for switches slow to go into forward conduction.

Figure 4:
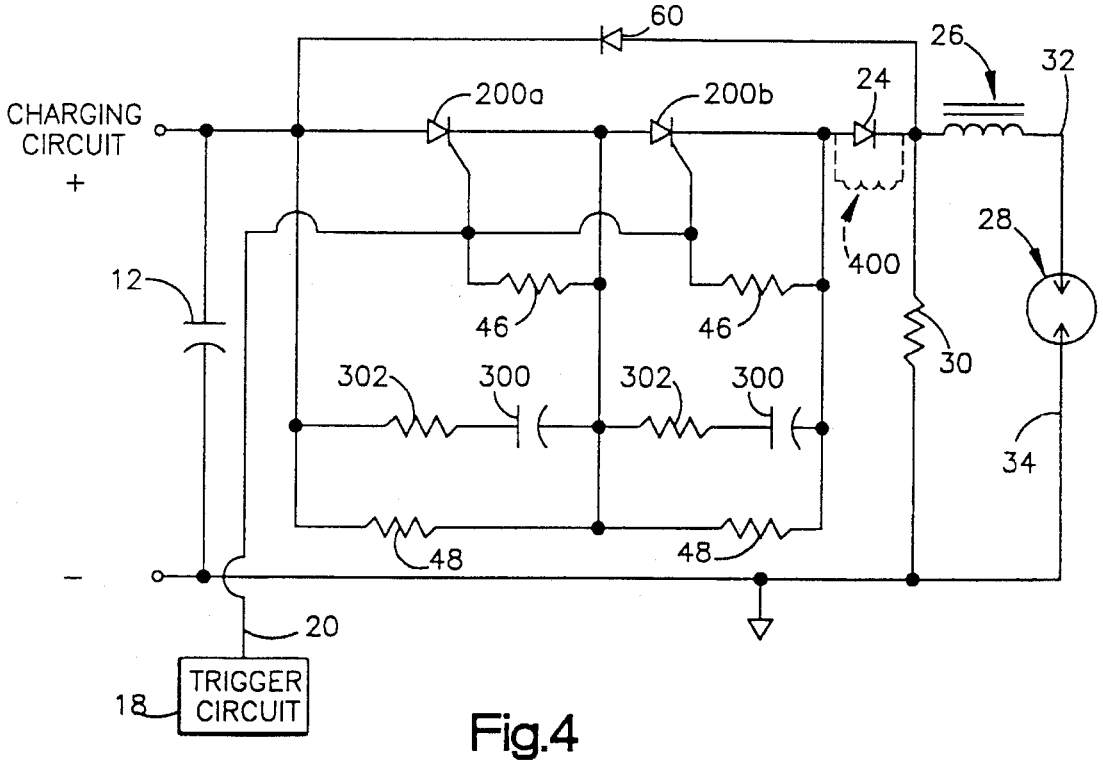

FIG. 4 illustrates another embodiment of the invention, wherein again like elements are given like reference numerals. This embodiment uses a different approach for realizing an oscillatory discharge by maintaining the switching devices in forward conduction by not permitting the devices to reverse recover and block during the negative oscillatory discharge half-cycles. As with the embodiments of FIGS. 1 and 3, the exciter includes the main capacitor 12, balancing resistors 48, switching devices 200*a*, 200*b*, trigger circuit 18, inductor 26, and inverse diode 60 all of which operate in substantially the same manner as in the previous described embodiments. The series diode 24 is again provided and is needed in the embodiment of FIG. 3 when a capacitive holding current circuit is used, as described herein.

Rather than re-triggering the switching devices 200*a,b* in response to dv/dt transitions across the switching devices, a capacitor 300 and series resistor 302 are connected across the anode to cathode of each switching device. The capacitor 300 is charged during the charging cycle when capacitor 12 is charged. When the switching devices turn on, capacitors 300 begin to discharge through resistors 302 and the associated switching device. Resistor 302 is selected to be large enough so that the capacitor 300 discharges slowly enough so as to maintain a holding current through the switching device to prevent the switching device from recovering to a blocking state. Each switching device has a minimum holding current specified for the device that is required to keep the device in conduction. In this embodiment, the capacitor 300 needs to discharge at least the holding current during each negative current half-cycle (when diode 60 is conducting) of the exciter discharge period. Note in the embodiment of FIG. 4, each switching device 200*a,b* is directly triggered by the circuit 18. The diode 24 is used to block reverse bias voltages from appearing across the switches 200 when the diode 60 is conducting current. This allows the switches 200 to remain in forward conduction to discharge the capacitors 300.

It should also be noted that the holding current concept embodied in FIG. 4, can be incorporated into the embodiment of FIG. 1. This can be realized by choosing a resistance value for resistor 50 to be high enough so that the gate capacitor 42 more slowly discharges through the associated switching device 100 to maintain forward conduction. The larger resistance of resistor 50 will not adversely affect the retrigger operation of the circuit 40 because the by-pass diode 44 provides a low impedance shunt around the resistor when gate drive is needed. Again, the diode 24 will permit the switches 100 to remain in forward conduction due to the holding current even when the diode 60 is forward biased during the negative exciter discharge half-cycles. When the value of resistor 50 is selected to be a larger value to incorporate this holding current design, note that the current through the capacitor 42 slowly discharges and follows the wave form in FIG. 2 designated $I_3'$. Because the switches 100 remain in forward conduction, the dv/dt transitions and capacitor 42 re-trigger pulses are absent in trace $I_3'$.

Returning to FIG. 4, the values of resistor 302 and capacitor 300 can be selected, for example, so that the entire expected discharge cycle (for the oscillatory discharge to fully occur) is equated to one RC time constant. The values are then selected to assure that the capacitor 300 is discharging at least the worst case holding current at the end of one RC time constant.

We show an inductor 400 in phantom in FIG. 4. This inductor can be used as an alternative design for maintaining a holding current through the switches 200 during the negative discharge half-cycles. In such an arrangement, the inductor 400 is used in place of the diode 24, and the capacitors 300 and resistors 302 are also not needed. The modified circuit operates as follows. During the positive half-cycles, current through the switches 200 causes energy storage in the inductor 400. After the inductor 26 current reaches zero, the diode 60 begins to conduct the negative half-cycle discharge energy, but the inductor 400 also discharges its energy producing current through the switches 200 to maintain them in forward conduction. Note that the inductor 400 need only be sized large enough to store sufficient energy so that the holding current is maintained for the duration of each negative half-cycle. This is because during each positive half-cycle the inductor again stores energy. A saturable core inductor, air core or other suitable inductor can be used as needed for each application.

The embodiments of FIG. 4, of course, are but several examples of how to maintain a holding current through the switching devices, just as FIGS. 1 and 3 are examples of different techniques for re-triggering the switching devices back into conduction based on oscillatory discharge characteristics. The inventions herein likewise contemplate the methods embodied in the described embodiments, as well as the methods for re-triggering the switching devices, auto-triggering a chain of switching devices while externally triggering only one, and maintaining switching devices on with a minimum holding current, which methods can be utilized with oscillatory and unidirectional discharge exciters.

While the invention has been shown and described with respect to specific embodiments thereof, this is for the purpose of illustration rather than limitation, and other variations and modifications of the specific embodiments herein shown and described will be apparent to those skilled in the art within the intended spirit and scope of the invention as set forth in the appended claims.

We claim:

1. An oscillatory discharge exciter comprising: an input connectable to a power supply; an output connectable to an igniter; at least two energy storage elements for producing an oscillatory discharge of energy during an exciter discharge period; a unidirectional gated switch and a first rectifier coupled in reverse parallel, with each other and between the storage elements, to control during respective alternating half cycles oscillatory discharge energy at the exciter output; and a circuit for maintaining current through the switch for a plurality of its respective half cycles during the exciter discharge period.

2. The exciter of claim 1 wherein said switch is a solid state triggerable switch.

3. The exciter of claim 2 wherein said switch is a thyristor.

4. The exciter of claim 3 wherein said switch is selected from a group comprising GTO and SCR devices.

5. The exciter of claim 1 wherein the switch comprises an anode and a cathode and conducts current unidirectionally between its anode and cathode and blocks current between its anode and cathode when the anode to cathode current is below a holding current threshold.

6. The exciter of claim 5 wherein said circuit comprises a capacitance that maintains current at or above said holding current between the switch anode and cathode for a substantial portion of an exciter discharge period.

7. The exciter of claim 6 wherein said capacitance is coupled between the switch anode and cathode and is charged by the power supply during a time period that precedes an exciter discharge period.

8. The exciter of claim 7 wherein said capacitance is connected to a resistance to produce an RC delay discharge current through the switch that is long enough to maintain the switch in conduction during a predetermined portion of an exciter discharge period.

9. The exciter of claim 8 wherein said capacitance and resistance are connected in series, with the series combination thereof connected in parallel with the switch anode and cathode.

10. The exciter of claim 1 in combination with a second rectifier connected in series with the switch, with the series combination thereof connected in parallel with the first rectifier.

11. The exciter of claim 10 wherein said second rectifier blocks reverse voltage across the switch during the negative half-cycles so that said circuit can maintain at least a holding current through the switch during said plurality of cycles.

12. The exciter of claim 1 wherein the circuit comprises an inductor in series with the switch; the series combination of the switch and inductor being in parallel with the first rectifier; said inductor maintaining current through the switch to prevent the switch from blocking forward current.

13. An oscillatory discharge exciter comprising: an input connectable to a power supply; an output connectable to an igniter; at least two energy storage elements for producing an oscillatory discharge of energy during an exciter discharge period; a unidirectional gated switch and a rectifier coupled in reverse parallel, with each other and between the storage elements, to control during respective alternating half cycles oscillatory discharge energy at the exciter output; and a circuit for gating the switch in response to voltage transitions across the switch.

14. The exciter of claim 13 wherein the switch is a gate triggered device that can block forward current during the half cycles of discharge energy through the rectifier, said circuit re-triggering the switch in response to forward voltage transitions across the switch.

15. The exciter of claim 13 wherein the switch comprises an anode, cathode and gate; and said circuit comprises a capacitor coupled at one end to the switch anode and at another end to the switch gate.

16. The exciter of claim 13 wherein the switch comprises a plurality of gate controlled devices connected in series, each of said devices having a respective capacitance coupled between its anode and gate for producing a trigger signal to turn the device on; the exciter further comprising a timing circuit for applying a trigger pulse to at least one device gate.

17. The exciter of claim 13 in combination with a second rectifier connected in series with the switch, with the series combination thereof connected in parallel with the first rectifier.

18. A method for producing an oscillatory discharge from an exciter circuit through an igniter, comprising the steps of:

a. storing energy in a first energy storage element during a charging time period;

b. using a second energy storage element in combination with said first storage element to produce an oscillatory discharge for the igniter;

c. using a unidirectional switch to isolate the first storage element from the igniter during the charging period;

d. using the switch in combination with a rectifier during respective alternating half cycles of discharge for controlling oscillatory discharge through the igniter; and e. maintaining forward current through the switch during a discharge period.

19. The method of claim 18 wherein step e. comprises the step of using a capacitor to discharge at least a holding current through the switch during a discharge period.

20. A method for producing an oscillatory discharge from an exciter circuit through an igniter, comprising the steps of:

a. storing energy in a first energy storage element during a charging time period;

b. using a second energy storage element in combination with said first storage element to produce an oscillatory discharge for the igniter;

c. using a unidirectional gate controlled switch to isolate the first storage element from the igniter during the charging period;

d. using the switch in combination with a rectifier during respective alternating half cycles of discharge for controlling oscillatory discharge through the igniter; and e. during a discharge period, re-gating the switch into conduction in response to voltage transitions across the switch.

21. In an exciter that provides electrical energy from a storage element to an igniter, the combination of a plurality of solid state gated switches used to couple discharge energy between the storage element and the igniter; a trigger circuit for applying a trigger signal to the gate of one of said switches to turn said one switch on; and a gating circuit for gating said other switches on in response to signal transitions across said other switches when said one switch turns on.

22. The exciter of claim 21 wherein said gating circuit comprises, for each switch, a capacitance coupled between an anode of the switch and the switch gate.

23. The exciter of claim 21 further comprising means for producing an oscillatory discharge of energy in the igniter.

24. The exciter of claim 21 wherein each said switch comprises an anode and a cathode, said gating circuit turning said other switches on in response to anode to cathode voltage transitions across said other switches.

* * * * *